United States Patent [19]

Tatsuno

[11] 4,131,218

[45] Dec. 26, 1978

[54] APPARATUS FOR DISPENSING GASOLINE HAVING AN INVERTED U-SHAPED CONDUIT

[75] Inventor: Hiyoshi Tatsuno, Tokyo, Japan

[73] Assignee: Tokyo Tatsuno Co., Ltd., Tokyo, Japan

[21] Appl. No.: 716,619

[22] Filed: Aug. 23, 1976

[30] Foreign Application Priority Data

Sep. 3, 1975 [JP] Japan ..... 50/107440

[51] Int. Cl.[2] ..... B67D 5/06

[52] U.S. Cl. ..... 222/527; 137/355.16; 222/538

[58] Field of Search ..... 222/74, 75, 538, 539, 222/527, 173; 137/355.16, 355.17; 239/195, 197; 138/134, 137, 138; 302/34; 285/272

[56] References Cited

U.S. PATENT DOCUMENTS

| | | | |
|---|---|---|---|
| 1,790,500 | 1/1931 | Fischer | 138/138 X |
| 1,893,972 | 1/1933 | Whitman | 222/530 X |
| 2,544,119 | 3/1951 | Wolfe | 222/530 X |
| 2,544,121 | 3/1951 | Wolfe et al. | 222/530 X |
| 2,578,036 | 12/1951 | Berke | 222/538 X |
| 2,619,125 | 11/1952 | Eickmeyer et al. | 138/138 X |
| 2,622,900 | 12/1952 | Johnson | 285/272 |
| 2,804,243 | 8/1957 | Davenport | 272/527 |
| 2,930,514 | 3/1960 | Pacey | 222/530 |
| 3,395,723 | 8/1968 | Tatsuno | 222/74 X |
| 3,797,703 | 3/1974 | Yamawaki et al. | 222/538 X |

*Primary Examiner*—Stanley H. Tollberg
*Assistant Examiner*—Fred A. Silverberg
*Attorney, Agent, or Firm*—Frank J. Jordan

[57] ABSTRACT

A new and novel mounting for a flexible hose in a gasoline dispensing apparatus is disclosed. Contrary to a conventional mounting in which the hose is fixed to the apparatus housing at the one end and the other free end provided with a valved nozzle which is normally hung on the housing so that the intermediate length of the hose is suspended like the letter of "U", according to the present invention the hose is extended upwardly and then suspended downwardly so that this inverted "U" form is normally maintained by an elastic means such as a coiled spring fitted on the hose along at least the upwardly extended length. Thereby the force necessary for manually bringing the nozzle to the fuel inlet of a car can be considerably decreased and undesired hose dragging can be avoided which makes it possible to realize self-service system in a gasoline station.

10 Claims, 16 Drawing Figures

APPARATUS FOR DISPENSING GASOLINE HAVING AN INVERTED U-SHAPED CONDUIT

Figure 1:
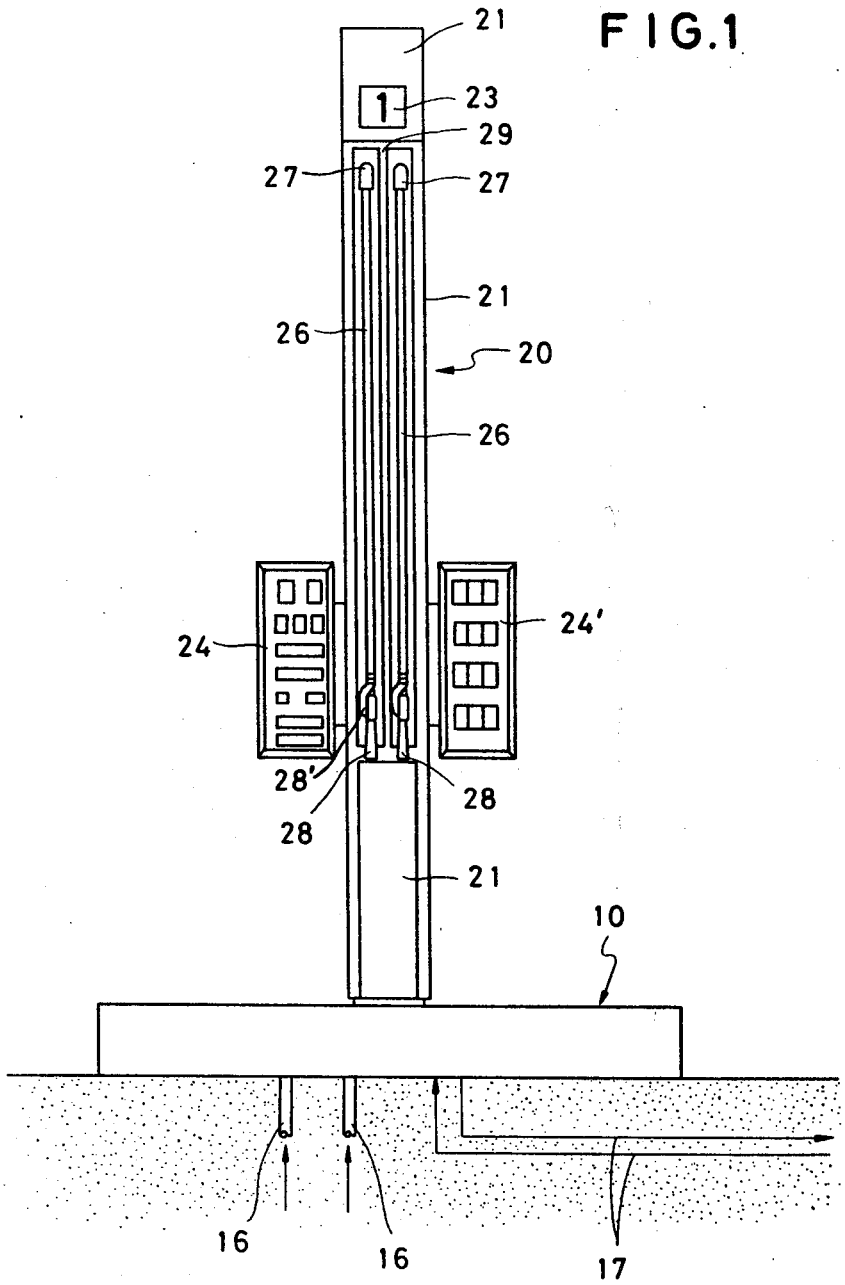

The present invention relates to an apparatus for dispensing gasoline or the like liquid, and more particularly to a mounting for a flexible hose having a nozzle at the free end thereof on the apparatus housing and which is dislodged for fuelling.

Various improvements have been proposed and made in respect of such fuelling apparatus for automotive vehicles inclusive of motor cars, but it is still common more or less to almost all such apparatuses available and installed at the present that a length of the flexible hose for dispensing is hung up in a single loop or a few loops, when the apparatus is not in use, on the housing generally containing pumping means and the like therein and having a panel provided with the quantity indicator and the like thereon.

The motor car to be fuelled enters the gasoline station and stops near the dispenser housing. The server takes up the valved nozzle connected to the hose at the free end thereof from a hanger on the housing and brings it into a fuel inlet hole of the car. According to such conventional mounting for the hose, the weignt of the valved nozzle and a considerable length of the hose and possible a swivel joint provided therebetween is fairly heavy to be manually held.

The inlet hole might be provided on the opposite side of the car. According to the result of a series of tests made by the inventor, 10 to 20% drivers park their cars in front of the pump housing with the fuel inlet side opposite thereto, despite the fact that they should know such side in respect of their own car although it varies depending on the car type, make of car and the like. In order to provide fuel to the car so parked, the server must walk about passing in front or back of the car to reach the opposite side while holding the nozzle and dragging the hose. When the hose is relatively short, he might stretch it over the bonnet or the roof of the car or under the car. Dragging the hose not only requires further physical force in addition to holding the valved nozzle and the like, but also causes wear of the hose and eventual soiling of the operator's clothes. Stretching the hose over the car may scratch the car body.

In view of the above, there has been hesitation for a long time to proceed with the so-called self-service system in respect of the gasoline station despite a strong desire for manpower saving, although recently developed electronics may have solved the other problems for attaining such goal. In fact the above defects in the conventional hose mounting make it difficult for old and female people to handle the hose.

In order to avoid said defects and for the purpose of effectively utilizing the narrow space of the gasoline station site, the inventor proposed the so-called "Non Space" gasoline filling system, according to which the usual pump housing is removed away from the ground surface and the hose is wound around a reel mounted on the ceiling so that when the reel is drivingly rotated, for instance by means of an electric motor, the free end of the hose is lowered down to such a level as to allow the operator's access to the nozzle but not hindering free movement of the car thereunder. When the reel is further rotated, the nozzle may reach the fuel inlet of the car. This system is disclosed in U.S. Pat. No. 3,395,723 granted to the present inventor and has been used considerably throughout the world. Such system is surely satisfactory so far as the skilled servers operate, but still difficult to be left to self-service. As readily understood, when the operation is given into the hands of the drivers or customers not familiar therewith, the most important problem is swinging of the suspended hose having a fairly weighty dispenser nozzle. In situations where the nozzle has been displaced for fuelling from the correctly perpendicularly suspended position, when the nozzle is carelessly or accidentally released, the swinging hose nozzle may hurt the person or damage the car. Or the customer may forget to retract the lowered hose upwardly which may also cause various troubles.

An object of the invention is, thus, to provide a new mounting for the flexible hose of a gasoline dispensing apparatus to be readily and neatly operated by any unskilled person.

The secondary but important object of the invention is to make it possible to realize the self-service system and save manpower in a gasoline station.

The aforementioned objects can be attained according to the invention basically by extending a length of the flexible hose upwardly and then downwardly so as to be normally kept in the form of long inverted "U" with aid of elastic means so that when manually pulling the valved nozzle against the elastic force the flexible hose may yield firstly at the top bent portion and the yielding portion is gradually lowered whereby the filling zone may be expanded with unexpectedly slight manual force and without any necessity of dragging the hose.

Figure 2:
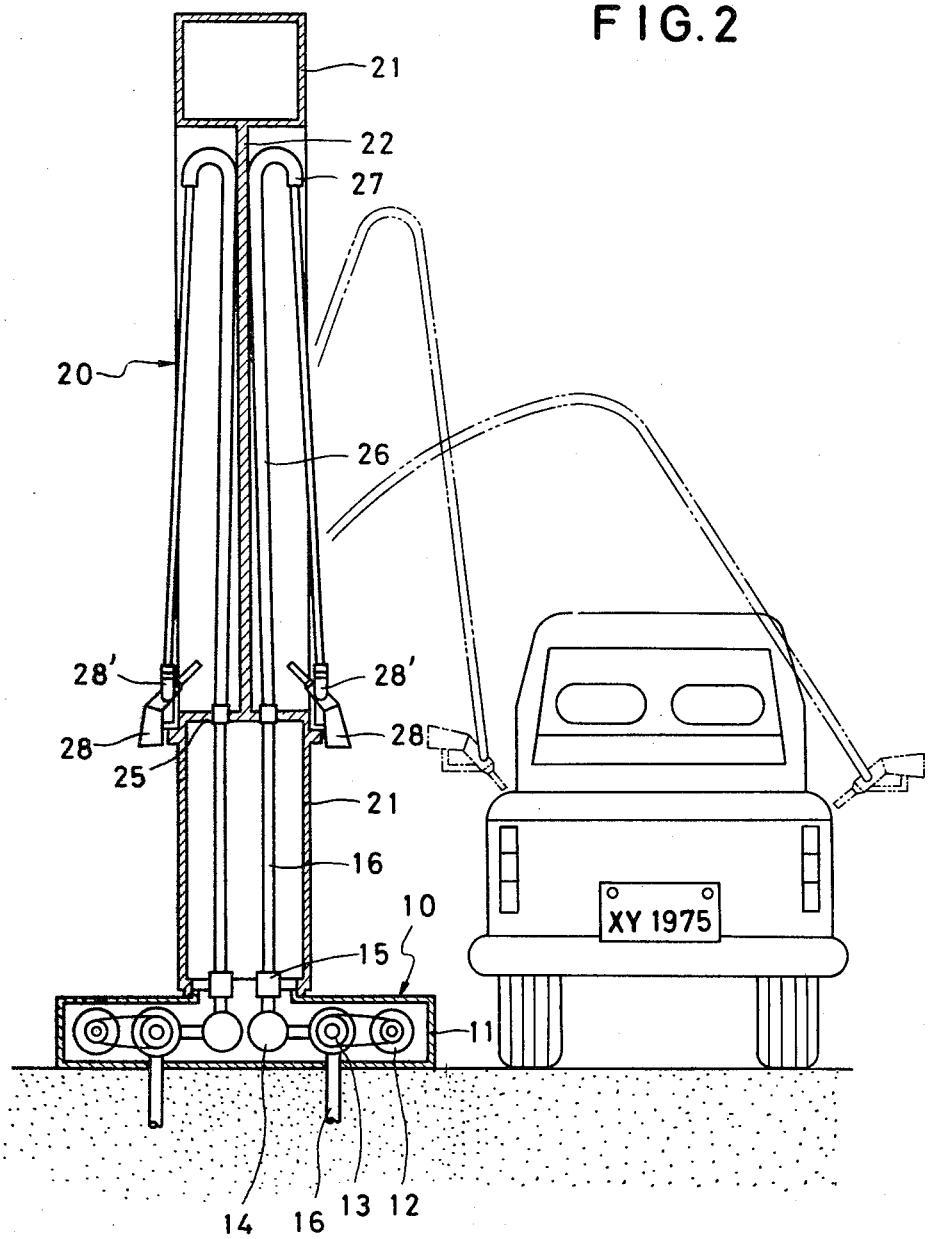
Figure 3:
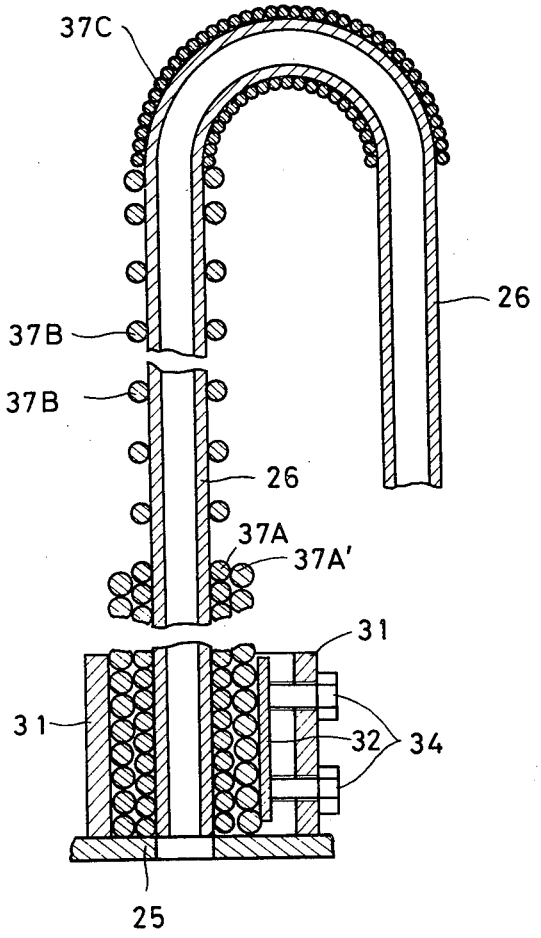
Figure 4:
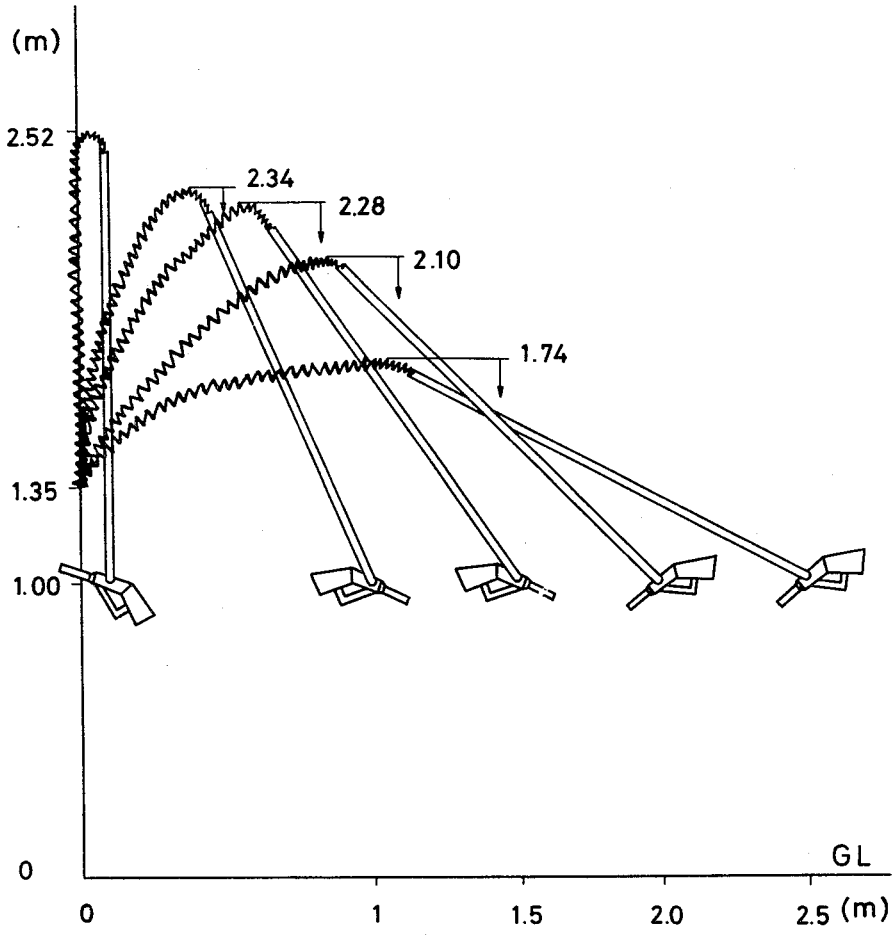
Figure 5:
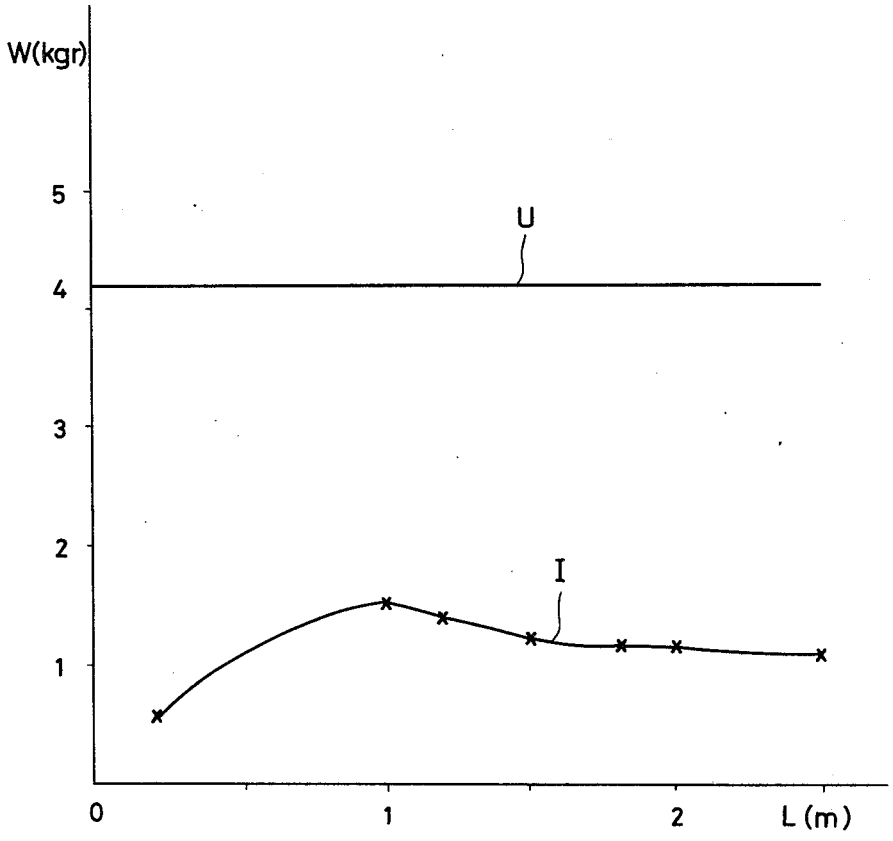
Figure 6A:
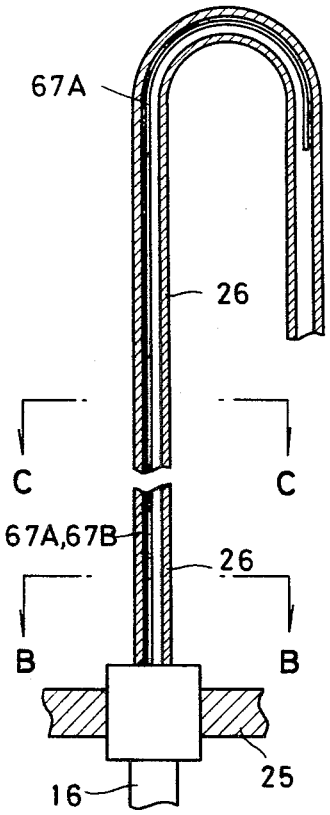
Figure 7A:
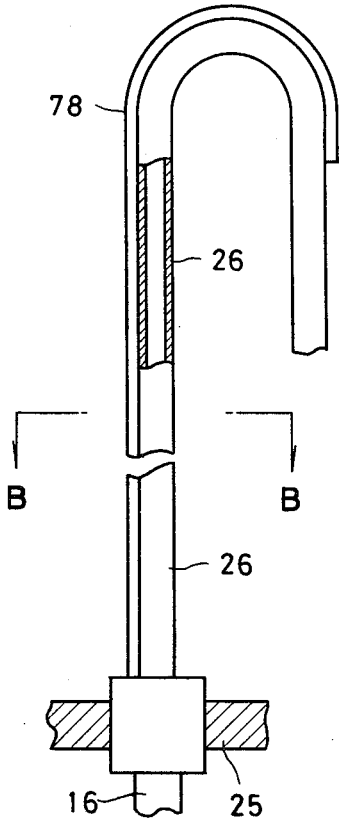
Figure 6B:
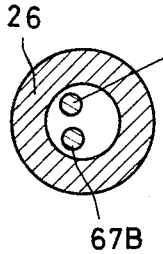
Figure 6C:
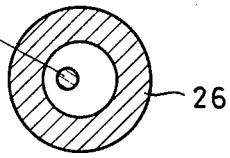
Figure 7B:
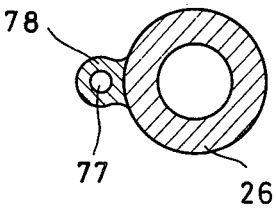
Figure 8A:
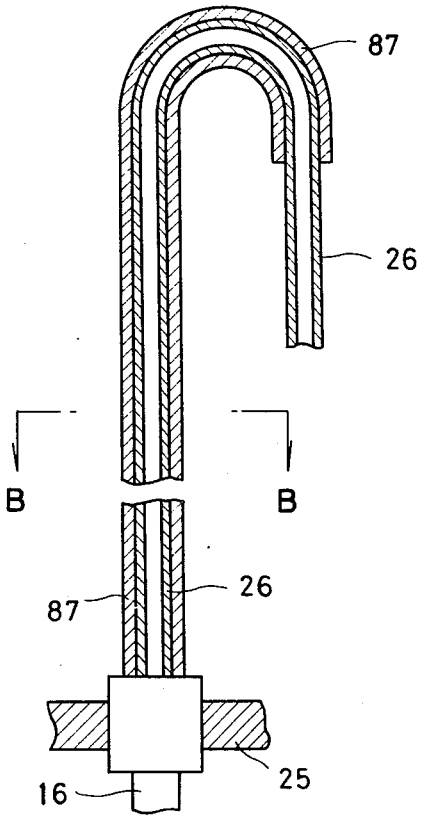
Figure 9A:
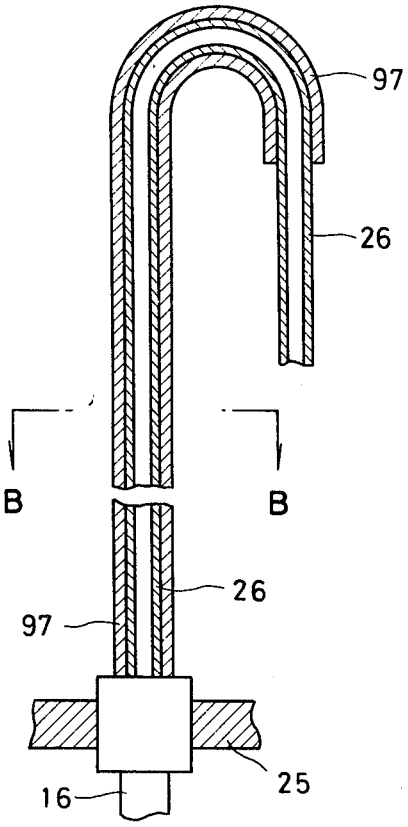
Figure 8B:
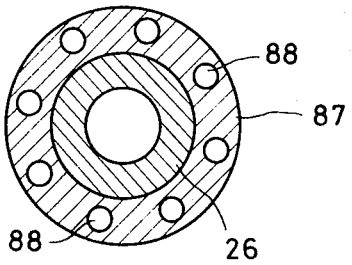
Figure 9B:
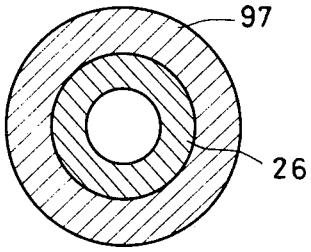
Figure 10:
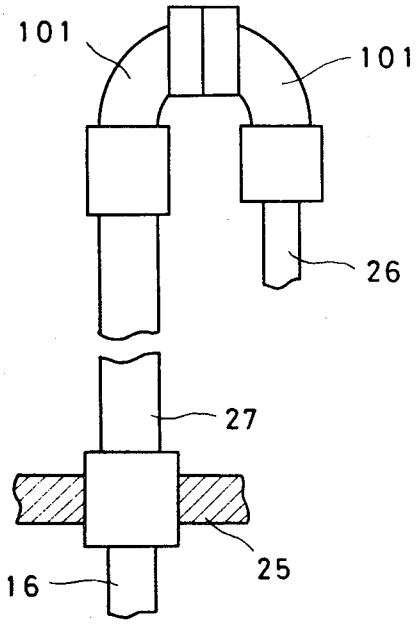
Figure 11:
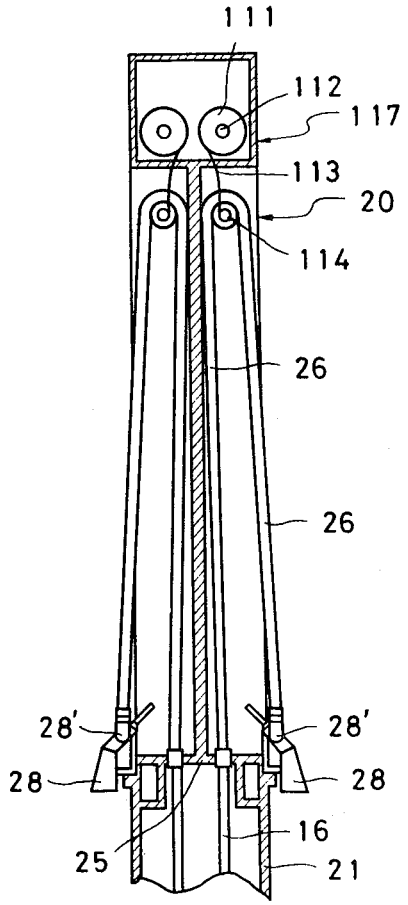

The other objects and advantages can be readily appreciated by studying the more detailed explanation of various embodiments to be made hereinafter in reference to the accompanying drawings, in which;

FIG. 1 is a schematic front elevation of a housing containing two flexible hoses in the front side thereof according to the invention, FIG. 2 a schematic side elevation partly in section of the housing of FIG. 1 showing two similar flexible hoses in the back side thereof and showing varied positions of the hose when fuelling, FIG. 3 is a side section of the flexible hose elastically strengthened along the upwardly extending length thereof according to the first embodiment, FIG. 4 is an illustration showing various positions of the elastically strengthened flexible hose of FIG. 3 when fuelling, FIG. 5 is a diagram in which the force exerted on a hand holding the hose nozzle is indicated by units of kilograms (Kgr.) in the ordinate while the distance between the normally hung nozzle position and the fuelling nozzle position is indicated by unit of meters (m.) in the abscissa according to the invention and in comparison with a conventional mounting in which the flexible hose is hung on the housing in the form of a "U", FIG. 6A is a schematic side section of the flexible hose elasticaly strengthened along the upwardly extending length thereof according to a second embodiment, FIG. 6B is a cross section taken along the line B—B in FIG. 6A, but in an enlarged scale, FIG. 6C is a similar cross section taken along the line C—C in FIG. 6A, FIG. 7A is a view similar to FIG. 6A but of a modification, FIG. 7B is a cross section taken along the line B—B in FIG. 7A, FIG. 8A is a view similar to FIG. 6A but of a third embodiment, FIG. 8B is a cross section taken along the line B—B in FIG. 8A, FIG. 9A is a view similar to FIG. 6A but of a modification of the second embodiment, FIG. 9B is a cross section taken along the line B—B in FIG. 9A, FIG. 10 is a side elevation partly in section of a elastically strengthened hose provided with a pair of swivel joints at the top bent portion, and FIG. 11 is a schematic side elevation partly in section similar to FIG. 2 but of a fourth embodiment of the invention.

In FIGS. 1 and 2, there is generally shown a gasoline filling apparatus of the self-service type which is made possible according to the invention and relating to a simple but novel manner of mounting the flexible hose. The illustrated apparatus involves four separate dispensing lines. The first dispenser shown at the right hand and the second at the left hand in FIG. 2 have respectively two lines, e.g. one for high octane number gasoline and the other for regular gasoline as seen in FIG. 1.

A base or island is represented generally by 10, which comprises a basic housing 11 installed on the ground surface at a suitable position of the station site, which basic housing contains therein an electric motor 12, a pump 13, a flow meter 14, an electromagnetic valve 15, and a fixed conduit 16 for each dispensing line so that when the motor 12 is energized the driven pump 13 will pump up gasoline from the reservoir parenthesis not shown via the fixed conduit 16 which includes the flow meter 14 to determine the amount of the fuel supplied to the customer's car and the valve 15 to be electromagentically actuated by a clerk in the office cabin. In order to transmit an electric signal for energizing the valve 15 and other various signals for facilitating the control of a plurality of self-service apparatuses, electric leads 17 may be provided. The basic housing containing the elements as referred to above may be burried under the ground surface. The matters referred to above are partly conventional and partly novel but either thereof has no direct connection with the invention.

On the base 10, a vertically elongated housing represented generally by 20 is installed, which is defined by walls 21 to form a hollow housing of a few meters height although the vertical dimension is not critical, and divided into two sections by a vertical partition 22 (FIG. 2). At the top of the housing 20, there is provided a numeral figure represented by 23, which is for instance "1" as shown in FIG. 1 so as to identify the dispenser as the first one in the gasoline station. At the back and corresponding portion of FIG. "2" may be given for identifying the left dispenser in FIG. 2. A pair of frames 24 for indicators and 24' for actuators (FIG. 1) are mounted on the housing 20 so as each transversely project at such a level to allow easy access to the actuators and being ready to read the indicators for the customers in respect of the first dispenser. There is provided a transversely extending partition 25 in the housing 20 at a level of 1 to 1.5 m. from the ground surface by reasons to be appreciated and referred to hereinafter. The fixed conduit 16 extends from the valve 15 referred to above upwardly to said transverse partition 25.

According to an essential feature of the invention, a flexible hose 26 having one end connected with the upper end of the fixed conduit 16 and fixedly mounted on the transverse partition 25 is upwardly extended just below the top wall of the housing 20 and downwardly suspended to normally form a long inverted "U" shape by elastic means 27 which may be, although not limited to one or more coiled springs fitted on the hose along at least the upwardly extended length, although it may be various to be referred to hereinafter. The free end of the hose 26 is provided with a usual valved nozzle 28 via a swivel joint 28'. There is preferably provided a longitudinal central partition 29 so as to form two vertically long rooms at the front side of the housing 20 between each of the opposite side walls 21 for separately receiving the two hoses 26.

Details of the elastic means 27 for keeping the flexible hose 26 normally in the inverted long "U" shape shall be explained hereinafter in respect of several embodiments, but the operation of the new and creative mounting for the flexible hose 26 shall briefly be explained here. Since the flexible hose 26 is made elastically self-sustained with the means 27, the valve nozzle 28 is elastically suspended at the position. It is preferably held by a receiver or hanger mounted on the housing 20 at the corresponding position. Even if the nozzle 28 is taken up by the customer from the hanger, thus, he will feel substantially no considerable weight difference from the conventional hose mounting in which all of the weight of the valved nozzle, all of the length of the hose not contacting the ground surface midway or a part of the length between the free end and the middle portion contacting the ground, and possibly the swivel joint provided therebetween must be held.

Usually the driver parks the car in front of the fuel dispenser facing the fuel inlet side thereto as referred to above. Thus he may readily bring the manually held nozzle 28 to the fuel inlet of the car by slightly pulling the nozzle. The configuration of the yielding hose varies depending on the elastic force and the like, but one example may be shown by phantom lines in FIG. 2. When the fuel inlet is at the opposite side of the car, the driver must pull the nozzle 28 as shown by another phantom lines, in which a little stronger pulling force is necessary, but this is far less than the weight to be manually held in the conventional apparatus mounting. More detailed matters in this respect shall be explained hereinafter.

It will be appreciated that the elasticity of the means 27 should be made strong enough for normally and stably keeping the flexible hose 26 in the inverted long "U" shape on the one hand, but preferably weak as far as possible in order to lighten the pulling and holding force necessary for fuel filling against the elastic force on the other hand so that both must be compromised to a suitable value. It has been found preferable to make the elasticity relatively strong at the root portion and relatively weak at the upper portion of the upwardly extended length of the hose 26, in order to lower the compromising elastic force. It is also been found preferable more or less to mount the root end of the flexible hose 26 in such a way that the upwardly extended and elastically strengthened length thereof is a little slanted upwardly toward the back for attaining the desired purpose and in order to facilitate ready restoration of the yielding hose to the normal position when the nozzle is released. It is added that the degree, distribution and the like of the necessary elasticity and the degree of preferred slant referred to above are not at all critical but varied depending on the various conditions inclusive of the hose length.

Now with reference to FIG. 3, the first embodiment of the elastic means 27 as illustrated in FIGS. 1 and 2 shall be explained, in which a plurality of coiled springs are used. In order to extend the fuel filling zone as far as possible, the length of the flexible hose should correspondingly be long. Since the law relating to the fire fighting or rather prevention in Japan restricts the length of the flexible hose in a gasoline station to be shorter than 3 meters, the 3 meters length usual nylon corded hose 26 was used having a weight of 2 Kgr. and inner and outer diameters respectively of 18 mm. and 30 mm. Such length is sufficient for fuel filling of a car whose fuel inlet is on the opposite side. The flexible hose 26 is connected to the conduit 16 and fixed on the partition wall 25 as referred to above at a level of 1.35 m. from the ground surface. A first and inner coiled spring 37A made of 6 mm. diameter usual steel wire is of a helix pitch zero, i.e. of every adjacent spiral turn contacts with each other, the inner diameter is snugly fitted on the hose 26, and it has a length of 30 cm., which is fitted on the hose so as to be extended upwardly from the root thereof. An outer coiled spring 37A' is similar to said inner spring 37A but made of 8 mm. wire and of a little larger turn diameter so as to be fitted snugly on the spring 37A.

In order to fix the flexible hose 26 to the partition 25, it is preferable to provide a cylinder 31 fixedly mounted on the transverse partition 25 so as to receive the root portion of the hose 26 fitted with the coiled springs 37A, 37A' therein. A movable plate 32 is inserted in a space between the outer surface of the outer coiled spring 37A' and the inner surface of the cylinder 31 so as to be pressed toward the former by means of a set of threaded screws 34.

A second coiled spring 37B made of 6 mm. diameter wire is of 6 cm helix pitch, 90 cm. length, and fitted snugly on the hose 26 above the first coiled springs 37A, 37A'. Thus the upwardly extended length of the hose is elastically strengthened along 120 cm.

A third coiled spring 37C made of 3 mm. diameter usual steel wire is of zero helix pitch. This third one is previously bent so that when fitted snugly on the hose it normally hold, the top bent portion of the hose 26 by 5.6 cm. to its curvature and radius, and otherwise the flexible hose 26 would be bent by a considerably larger curvature radius despite the valved nozzle 28 and swivel joint 28' which total 2.2 Kgr. and which are mounted at the free end thereof. The downwardly suspended length of the hose is 150 cm.

According to the tests made in respect of the embodiment as referred to above, the varied configurations of the bent flexible hose 26 are shown in FIG. 4, and the varied forces affected on the hand holding the nozzle 28 are illustrated in FIG. 5 respectively when transversely pulling the nozzle 28.

FIG. 4 shows that the fixed root end of the hose is at a level of 1.35 m. from the ground surface and the height of the upwardly and very slightly slanted extended length of the hose 26 is 2.52 m. When the manually held nozzle 28 is pulled 1 m., 1.5 m., 2 m. and 2.5 m. respectively at the same level of 1 m. from the ground surface, the height is reduced to 2.34 m., 2.28 m., 2.1 m. and 1.74 m. respectively.

FIG. 5 shows that the force W exerted by the hand holding the nozzle 28 is given by a unit of Kgr. in ordinate and the distance L of the nozzle 28 from the upwardly extended hose is given by a unit of m. in the abscissa. A linear line U shows the force W is always 4.2 Kgr. regardless how far the hose 26 is transversely extended according to the conventional mounting for the flexible hose (2Kgr.) provided with the swivel joint and nozzle (total weight 2.2 Kgr.). A curve I is of the invention. When the nozzle 28 is dislodged from the hanger, the force or weight W suspended by the hand is only 500 gr. When pulling the nozzle 28 by 1 m. the force W is a little increased but only to 1.5 Kgr. This is the peak as readily appreciated and the force W is decreased when the nozzle is further pulled.

The advantage of the invention lies not only in this considerable decrease of the necessary force but also in eliminating the necessity of dragging the hose as referred to above.

Instead of the coiled spring, a long bar of any elastic mateial such as a thick steel wire or a glass fiber rod may be used as illustrated in FIGS. 6A, 6B, 6C and FIGS. 7A, 7B. Firstly in FIGS. 6A, 6B and 6C, there is shown a steel wire 67A of such length as to be a little longer than the upwardly extended length of the hose 26 and having the upper portion thereof previously bent for normally keeping the desired bent top portion of the hose 26 as described above in respect of FIG. 3. It is preferable to provide a second or auxiliary steel wire 67B of shorter length, e.g. a third of the main wire 67A and similarly fixed only at the root thereof, for the reason described above. Of course a glass fiber rod like a fishing rod of which thickness is gradually made thinner toward the upper end may be used instead of the above. In FIGS. 7A and 7B, such a glass fiber rod 77 is used, but arranged splintedly along and back of the hose 26 and thus different from the above arrangement of FIGS. 6A, 6B and 6C. On the rod 77 there is preferably covered a sheath 78 so as to integrate the rod 77 with the hose 26.

In FIGS. 8A, 8B and FIGS. 9A, 9B, an elastic sleeve is used. Firstly in FIGS. 8A and 8B, there is shown a vertically elongated rubber sleeve 87 involving a plurality of steel wires 88, eight wires in the illustrated embodimeht, embedded in parallel in the sleeve with substantially the same space between each adjacent two wires. The sleeve 97 in FIGS. 9A and 9B is made of glass fiber and any suitable binder.

FIG. 10 shows a modification from another view point, in which the length of the flexible hose 26 is cut into two upwardly extending and downwardly suspending lengths so that the former is elastically strengthened by any elastic means 27 and connected with the latter hose length by means of an intermediate swivel joint 101 for allowing more free movability of the suspended nozzle 28 in the transverse direction.

The various embodiments of the invention referred to above all relate to the elastic means for elastically strengthening the flexible hose to be self-sustained, but the elastic means may take another form to normally keep the flexible hose in the inverted elongated "U" shape. In FIG. 11 there is provided a wire reel represented generally by 117 which comprises a reel 11 rotatably mounted 112 on the housing 20 at the top thereof and having a length of wire 113 normally elastically urged to be wound therearound by means of any spring (not shown). The free end of the wire 113 is fixed to a pulley 114 to be floatingly suspended. The flexible hose 26 of which its root end is connected to the fixed conduit 16 at the transverse partition 25 in the housing 20, is extended upwardly to pass around said pulley 114 and then suspended downwardly to have the valved nozzle 28 at the free end thereof. It is readily appreciated that when pulling the nozzle 128 similarly as in the above embodiments against the spring means in the reel 117, the pulley 114 is yieldingly lowered so as to allow the nozzle 28 to be brought to the fuelling position.

As referred to above the mounting for the flexible hose of the gasoline dispenser according to the invention makes it ready to manually bring the hose nozzle to the fuel inlet of the car. And consequently the invention makes it possible to realize a self-service system in a gasoline station for instance as follows.

Supposing that the left frame 24 in FIG. 1 is for intance the manipulation board involving various instruction notes and push button switches, and the right frame 24' is the indicator board, and that the driver has parked his car in front of the No. 1 dispenser as shown in FIG. 2, firstly he will see the concerned instruction note to take the nozzle 28 off the hanger in the left dispensing line for the regular gasoline in FIG. 1. Electrically linked with the taking off of the nozzle, then, concerned indicator lamps are energized for showing "In Use", "Regular Gasoline" and instructing "Push Reset Button" on the left board 24. When it is pushed, the indicated volume of gasoline supplied the last time is reset to zero on the right board 24', and through the leads 17 an indicator lamp in the office cabin is ignited for showing the No. 1 dispenser is to be operated for fuelling regular gasoline.

When pushing a preset button for a required volume (liter, gallon or the like) according to the concerned instruction on the left board 24, the corresponding volume and the corresponding money sum (Yen, Dollar or the like) are numerically indicated on the right board 24', and the instruction is changed over to "Bring Nozzle To Car Inlet". A clerk who may be only one employee in the gasoline station for treating a plurality of the dispensers therein, can confirm this by corresponding energization of the light in the cabin, and after confirming the safety, actuates the switch for energizing the corresponding motor 12 to drive the pump 13 and the electromagnetic valve 15 to open and closing the concerned electric circuit so that the operation of the flow meter 14 may be reflectingly indicated on the right board 24'. When the customer triggers the valve of the nozzle 28 in reply to the instruction on the left board 24, the regular gasoline in the corresponding reservoir is supplied to his car so that the supplied gasoline volume and the corresponding money sum are momentarily integratedly indicated on the right board 24' while the indicated numerical figures of the preset volume and the money sum are momentarily substracted.

When the supplied gasoline volume amounts to the preset level, the electromagnetic valve 15 and the motor 12 are automatically de-energized, and the lighted instruction note is changed over to "Hang Nozzle". When it is hung, the instruction is changed over to "Bring Slip To Office" and the slip printed with various particulars including, dispenser number, gasoline volume, money sum and the like is issued out of the concerned slit.

What is claimed is:

1. A fuel filling apparatus comprising a fuel reservoir, a stationary conduit having one end leading from said reservoir, a dispensing nozzle, a flexible conduit, a pumping means for transferring the fuel from said reservoir and dispensing the fuel through said flexible conduit to said dispensing nozzle, and elastic means disposed along at least part of said flexible conduit to resiliently support said flexible conduit in a normally substantially inverted U-shaped configuration, an elongated vertical housing in which said inverted U-shaped conduit is disposed, said vertical housing being divided at a fixed elevation into a lower portion and an upper portion, said stationary conduit being disposed in said lower portion, said upper portion of said housing having at least three vertical side walls having a horizontal cross section which is generally U-shaped with one vertical side portion which is open, said U-shaped conduit having an upwardly extending and substantially vertically disposed flexible conduit portion and a downwardly extending flexible conduit portion joined together by a cross-over flexible conduit portion, said upwardly extending flexible conduit portion having one end thereof connected by first connecting means to said stationary conduit at said fixed elevation, said downwardly extending portion having its downstream end thereof connected to said dispensing nozzle by second connecting means, a receiver means on said housing adjacent said fixed elevation for holding said nozzle when the latter is not dispensing fuel, said elastic means being constructed and arranged on said flexible conduit such that upon manual displacement of said dispensing nozzle in a generally lateral direction, said flexible conduit will be resiliently flexed and displaced as the flexible conduit is moved out of said housing through said open vertical side portion such that said cross-over flexible conduit portion is lowered to thereby increase the area for fueling vehicles with said dispensing nozzle, said flexible conduit in its unflexed condition having its inverted U-shaped configuration extending from said first connecting means to said second connecting means such that the flexible conduit in its inverted U-shaped unflexed condition supports a substantial portion of the weight of said nozzle in a position adjacent to said receiver means and said flexible conduit in its inverted U-shaped unflexed condition is accommodated in said housing.

2. A fuel filling apparatus according to claim 1, wherein said second connecting means comprises a swivel joint.

3. A fuel filling apparatus according to claim 1 wherein said elastic means comprises a plurality of coil springs disposed on said flexible conduit, at least one of said coil springs being disposed over another of said coil springs.

4. A fuel filling apparatus according to claim 1 wherein said upwardly extending flexible conduit portion has a root portion at said one end which is connected to said stationary conduit and an upper portion extending between said root portion and said cross over portion, said elastic means comprising a plurality of coil springs disposed about said root portion and said upper portion, said coil spring disposed about said root portion being stronger than the coil spring disposed about said upper portion.

5. A fuel filling apparatus according to claim 1 wherein said upwardly extending flexible conduit portion has a root portion at said one end which is connected to said stationary conduit and an upper portion extending between said root portion and said cross over portion, said elastic means comprising a first spring disposed about said root portion, and a second spring disposed about said first spring.

6. A fuel filling apparatus according to claim 5 further comprises a third spring disposed about said upper portion, and a fourth spring disposed about said cross over portion.

7. A fuel filling apparatus according to claim 6 wherein said third spring has a greater helix pitch than said first, second, and fourth springs.

8. A fuel filling apparatus according to claim 6 wherein each of said springs is made of coiled members, the diameter of the coiled member of said fourth spring being less than the diameter of the coiled members of said first, third and fourth springs.

9. A fuel filling apparatus according to claim 6 wherein said first, second and third springs have substantially zero helix pitch.

10. A fuel filling apparatus according to claim 1 wherein two of said flexible conduits are provided, said housing having one compartment for one flexible conduit and another juxtaposed compartment for the other flexible conduit.

* * * * *